US009982642B2

(12) United States Patent
Matteini et al.

(10) Patent No.: US 9,982,642 B2
(45) Date of Patent: May 29, 2018

(54) COUPLING DEVICE AND FUEL INJECTOR ASSEMBLY

(71) Applicant: Continental Automotive GmbH, Hannover (DE)

(72) Inventors: Davide Matteini, Leghorn (IT); Daniel Marc, Leghorn (IT); Marco Pasquali, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 15 days.

(21) Appl. No.: 14/399,027

(22) PCT Filed: May 2, 2013

(86) PCT No.: PCT/EP2013/059094
§ 371 (c)(1),
(2) Date: Nov. 5, 2014

(87) PCT Pub. No.: WO2013/167447
PCT Pub. Date: Nov. 14, 2013

(65) Prior Publication Data

US 2015/0128908 A1 May 14, 2015

(30) Foreign Application Priority Data

May 8, 2012 (EP) ..... 12167095

(51) Int. Cl.
*F02M 61/14* (2006.01)
*F02M 55/00* (2006.01)
*F02M 55/02* (2006.01)

(52) U.S. Cl.
CPC ..... *F02M 61/14* (2013.01); *F02M 55/004* (2013.01); *F02M 55/025* (2013.01);
(Continued)

(58) Field of Classification Search
CPC ... F02M 2200/0852; F02M 2200/0853; F02M 2200/0856; F02M 55/004; F02M 55/005;
(Continued)

(56) References Cited

U.S. PATENT DOCUMENTS 5,005,878 A * 4/1991 Smith ..... F02M 55/004 285/319
5,038,738 A * 8/1991 Hafner ..... F02M 55/004 123/456
(Continued)

FOREIGN PATENT DOCUMENTS

EP 1793122 A1 * 6/2007 ..... F02M 55/004
EP 1892408 A1 * 2/2008 ..... F02M 61/14
(Continued)

OTHER PUBLICATIONS

European Search Report, Application No. 12167095.4, 5 pages, dated Oct. 26, 2012.
(Continued)

*Primary Examiner* — Mahmoud Gimie
*Assistant Examiner* — John Zaleskas
(74) *Attorney, Agent, or Firm* — Slayden Grubert Beard PLLC

(57) ABSTRACT

A coupling device for mechanically and hydraulically coupling a fuel injector to a fuel rail of a combustion engine is disclosed. The coupling device includes a fuel injector cup having a central longitudinal axis and extending from an inlet side for hydraulically coupling to the fuel rail and an outlet side for engaging a fuel inlet portion of the fuel injector, and a collar element coupled to the fuel injector cup. The collar element includes at least one leg portion having a bridge section and at least one branch section extending radially away from the fuel injector cup. The branch section(s) are arranged radially outwardly of the
(Continued)

bridge section and project beyond the bridge section in both (b) a tangential direction perpendicular to the radial direction and perpendicular to the longitudinal axis and (b) a longitudinal direction parallel to the longitudinal axis.

16 Claims, 6 Drawing Sheets

(52) U.S. Cl.
CPC ..... *F02M 2200/8015* (2013.01); *F02M 2200/853* (2013.01); *F02M 2200/856* (2013.01); *Y10T 29/53961* (2015.01)

(58) Field of Classification Search
CPC .... F02M 55/025; F02M 61/14; F02M 61/168; F02M 69/465
USPC ..... 123/456, 468, 469, 470, 471; 29/281.1; 239/600
See application file for complete search history.

(56) References Cited

U.S. PATENT DOCUMENTS 5,520,151 A * 5/1996 Gras ..... F02M 41/14 123/469
6,382,187 B1 * 5/2002 Scollard ..... F02M 55/004 123/468
6,457,456 B1 * 10/2002 Scollard ..... F02M 61/145 123/470
6,481,420 B1 * 11/2002 Panasuk ..... F02M 55/004 123/469
6,668,803 B1 * 12/2003 McClean ..... F02M 61/14 123/456
6,874,478 B2 * 4/2005 Minoura ..... F02M 55/004 123/470
7,360,524 B2 * 4/2008 Zdroik ..... F02M 55/005 123/469
7,398,767 B2 * 7/2008 Kondo ..... F02M 61/145 123/468
7,415,970 B2 * 8/2008 Zdroik ..... F02M 55/005 123/469
7,438,055 B1 * 10/2008 Xu ..... F02M 61/14 123/456
7,467,618 B2 * 12/2008 Zdroik ..... F02M 55/005 123/470
7,556,022 B1 * 7/2009 Doherty ..... F02M 55/004 123/470
7,942,453 B2 * 5/2011 Grandi ..... F02M 55/005 285/305
2004/0237939 A1 12/2004 Kondo et al. ..... 123/470
2006/0137659 A1 6/2006 Zdroik et al. ..... 123/470
2007/0175450 A1 * 8/2007 Eckbauer ..... F02M 55/00 123/470
2008/0105236 A1 * 5/2008 Scheffel ..... F02M 61/14 123/470
2008/0302336 A1 * 12/2008 Fuerst ..... F02M 55/025 123/470
2009/0056674 A1 * 3/2009 Furst ..... F02M 61/14 123/470
2009/0173317 A1 * 7/2009 Doherty ..... F02M 55/004 123/456
2010/0012093 A1 * 1/2010 Pepperine ..... F02M 55/004 123/470
2010/0218743 A1 * 9/2010 Marc ..... F02M 55/025 123/470

FOREIGN PATENT DOCUMENTS

GB 2324337 A 10/1998 ..... F02M 55/02
WO WO 2011144411 A1 * 11/2011 ..... F02M 61/14
WO 2013/167447 A1 11/2013 ..... F02M 61/14

OTHER PUBLICATIONS

International Search Report and Written Opinion, Application No. PCT/EP2013/059094, 9 pages, dated Nov. 5, 2014.
European Office Action, Application No. 13720374.1, 3 pages, dated Jul. 21, 2017.

* cited by examiner

COUPLING DEVICE AND FUEL INJECTOR ASSEMBLY

CROSS-REFERENCE TO RELATED APPLICATIONS

This application is a U.S. National Stage Application of International Application No. PCT/EP2013/059094 filed May 2, 2013, which designates the United States of America, and claims priority to EP Application No. 12167095.4 filed May 8, 2012, the contents of which are hereby incorporated by reference in their entirety.

TECHNICAL FIELD

The invention relates to a coupling device for mechanically and hydraulically coupling a fuel injector to a fuel rail of a combustion engine. Furthermore, the invention relates to a fuel injector assembly with a fuel injector and a coupling device.

BACKGROUND

Coupling devices for mechanically and hydraulically coupling a fuel injector to a fuel rail are in widespread use, in particular for internal combustion engines. Fuel can be supplied from a fuel tank to an internal combustion engine by the fuel rail and the fuel injector.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, wherein the fuel injectors are arranged. The fuel injectors can be coupled to fuel injector cups in different manners. The coupling of the fuel injectors to the fuel injector cups that supply the fuel needs to be very precise to get a correct injection angle.

SUMMARY

One embodiment provides a coupling device for mechanically and hydraulically coupling a fuel injector to a fuel rail of a combustion engine, the coupling device comprising a fuel injector cup having a central longitudinal axis and extending from an inlet side for hydraulically coupling to the fuel rail and an outlet side for engaging a fuel inlet portion of the fuel injector, and a collar element being fixedly coupled to the fuel injector cup, wherein the collar element comprises at least one leg portion having a bridge section and at least one branch section, wherein the bridge section extends radially away from the fuel injector cup, wherein the at least one branch section is arranged subsequent to the bridge section in a radial direction away from the fuel injector cup, and wherein the at least one branch section projects beyond the bridge section in a tangential direction which is perpendicular to the radial direction and perpendicular to the longitudinal axis and in a direction along the longitudinal axis which is directed from the inlet side to the outlet side.

In a further embodiment, the at least one branch section extends beyond the fuel injector cup in the direction along the longitudinal axis which is directed from the inlet side to the outlet side.

In a further embodiment, the collar element is in one piece with the fuel injector cup.

In a further embodiment, the leg portion is L-shaped in top view along the longitudinal axis, each of the bridge section and the branch section representing one side of the L-shape.

In a further embodiment, the at least one leg portion has two branch sections projecting beyond the bridge section at opposite sides in the tangential direction so that the leg portion is T-shaped in top view along the longitudinal axis.

In a further embodiment, the collar element comprises two leg portions, each having at least one branch section which projects beyond the respective bridge section in a tangential direction which is perpendicular to the respective radial direction and perpendicular to the longitudinal axis and in a direction along the longitudinal axis which is directed from the inlet side to the outlet side, the two leg portions being arranged axially symmetric with respect to the central longitudinal axis.

In a further embodiment, two branch section represent a bracket for enclosing a portion of the fuel injector or of a spring element of the coupling device.

Another embodiment provides a fuel injector assembly with a fuel injector and a coupling device as disclosed above, wherein the coupling device is mechanically coupled to the fuel injector in such fashion that a rotational movement of the fuel injector relative to the fuel injector cup with respect to the direction of the central longitudinal axis is blocked by means of the at least one leg portion.

In a further embodiment, the at least one branch section of the collar element is in engagement with a contact surface of the fuel injector in a manner that a rotational movement of the fuel injector relative to the fuel injector cup with respect to the direction of the central longitudinal axis is blocked.

In a further embodiment, the fuel injector assembly comprises a spring element being arranged axially between the fuel injector and the fuel injector cup, and the spring element is coupled to the fuel injector in a manner that a rotational movement of the spring element relative to the fuel injector with respect to the direction of the central longitudinal axis is blocked, and the at least one branch section is in engagement with a contact surface of the spring element in a manner that a rotational movement of the fuel injector cup relative to the spring element with respect to the direction of the central longitudinal axis is blocked.

In a further embodiment, a clip element is in engagement with the fuel injector cup and with the fuel injector in a manner that the fuel injector is retained in the fuel injector cup in direction of the central longitudinal axis.

BRIEF DESCRIPTION OF THE DRAWINGS

Example embodiments of the invention are explained below with reference to the drawings, in which.

DETAILED DESCRIPTION

Figure 1:
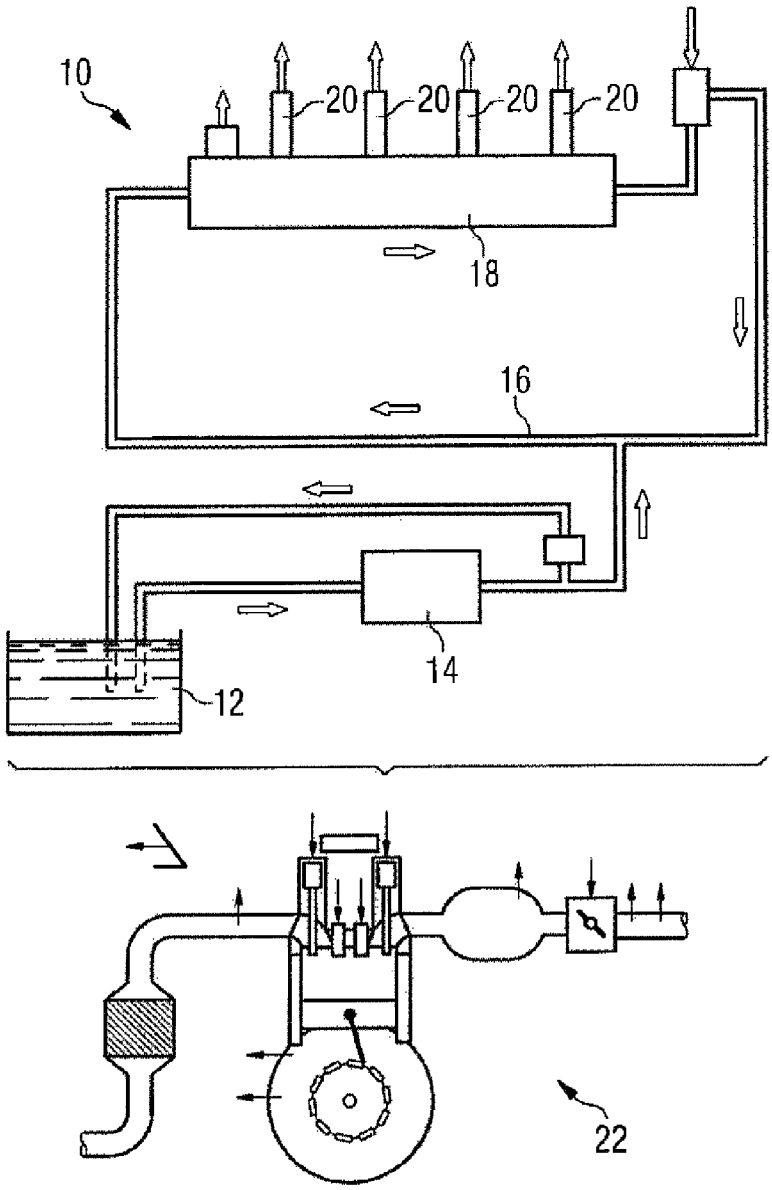
FIG. 1 shows an internal combustion engine in a schematic view.

Embodiments of the invention provide a coupling device for mechanically and hydraulically coupling a fuel injector to a fuel rail which is simply to be manufactured and which facilitates a reliable and precise coupling between the fuel injector and the fuel injector cup.

Some embodiments provide a coupling device for mechanically and hydraulically coupling a fuel injector to a fuel rail of a combustion engine. The coupling device comprises a fuel injector cup having a central longitudinal axis and extending from an inlet side for hydraulically coupling to the fuel rail to an outlet side for engaging a fuel inlet portion of the fuel injector. The coupling device comprises a collar element which is fixedly coupled to the fuel injector cup and is in particular extending radially away from the fuel injector cup. The collar element comprises at least one leg portion which is in particular designed to be coupled to the fuel injector in a manner that a rotational movement of the fuel injector relative to the fuel injector cup with respect to the direction of the central longitudinal axis is blocked, i.e. in particular prevented.

This has the advantage that a fast and secure coupling of the fuel injector in the fuel injector cup is possible. Furthermore, a defined positioning of the fuel injector relative to the fuel injector cup in circumferential direction is possible. Additionally, a low cost solution for the coupling device may be obtained.

The leg portion—or each or the leg portions, respectively—has a bridge section and at least one branch section. The bridge section extends radially away from the fuel injector cup. The at least one branch section is arranged subsequent to the bridge section in a radial direction away from the fuel injector cup.

The at least one branch section may project beyond the bridge section in a tangential direction which is perpendicular to the radial direction and perpendicular to the longitudinal axis. In this way, a particular efficient leverage may be achievable, so that the rotational locking between the fuel injector cup and the fuel injector by be particularly stable and/or precise.

Alternatively or additionally, the at least one branch section may project beyond the bridge section, and preferably beyond the fuel injector cup, in a direction along the longitudinal axis which is directed from the inlet side to the outlet side. In this way, the rotational locking function of the collar element may, with advantage, be usable already during mounting of the fuel injector cup with the fuel injector. In particular, the leg portion may couple to the fuel injector for blocking relative rotational movement via the branch portion when the fuel injector is inserted into the fuel injector cup before the fuel injector has reached its final mounting position within the fuel injector cup.

In one embodiment the collar element is in one piece with the fuel injector cup. This has the advantage that a simple construction of the coupling device is possible which allows carrying out a fast and secure coupling of the fuel injector in the fuel injector cup. Furthermore, the fuel injector cup with the collar element may be manufactured in a simple process, in particular a deep drawn process.

In a further embodiment the at least one leg portion is L-shaped, in particular in top view along the longitudinal axis. This has the advantage that the at least one leg portion may be manufactured in a simple manner. Each of the bridge section and the branch section may represent one side of the L-shape, in other words one leg of the "L".

In a further embodiment the at least one leg portion is T-shaped, in particular in top view along the longitudinal axis. This has the advantage that the collar element may be coupled to the fuel injector in a very secure manner. Specifically, the T-shaped leg portion may have two branch sections which project beyond the bridge section in the tangential direction at opposite sides of the bridge section to form the T-shape together with the bridge section.

In a further embodiment the collar element comprises two leg portions which are in particular arranged axially symmetric with respect to the central longitudinal axis. This enables a very secure coupling of the fuel injector to the fuel injector cup in two areas which are located opposite to each other relative to the central longitudinal axis.

In embodiments of the coupling device in which the collar element has at least two branch section—for example in embodiments having a leg portion comprising two branch sections which project beyond the bridge section in the tangential direction at opposite sides of the bridge section to form a T-shape together with the bridge section in top view along the longitudinal axis or in embodiments in which the collar element has two leg portions, each having at least one branch section which projects beyond the respective bridge section in a tangential direction which is perpendicular to the respective radial direction and perpendicular to the longitudinal axis and in a direction along the longitudinal axis which is directed from the inlet side to the outlet side—the two branch sections may be arranged to represent a bracket for enclosing a portion of the fuel injector or of a spring element of the coupling device for blocking rotational movement of the fuel injector cup in two opposite directions with respect to the fuel injector or the spring element, respectively.

Other embodiments provide a fuel injector assembly with a fuel injector and a coupling device according to the first aspect. Expediently, the coupling device (40) is mechanically coupled to the fuel injector (20) in such fashion that a rotational movement of the fuel injector (20) relative to the fuel injector cup (44) with respect to the direction of the central longitudinal axis (L) is blocked by means of the at least one leg portion (52, 54). The longitudinal axis of the fuel injector cup preferably also represents a longitudinal axis of the fuel injector.

In one embodiment, the at least one leg portion—in particular the at least one branch section thereof—is in engagement with a contact surface of the fuel injector in a manner that a rotational movement of the fuel injector relative to the fuel injector cup with respect to the direction of the central longitudinal axis is blocked or prevented. Particularly, the at least one leg portion is in form-fit engagement with the contact surface of the fuel injector. This has the advantage that the defined positioning of the fuel injector relative to the fuel injector cup in circumferential direction may be carried out in a simple manner.

In a further embodiment, the fuel injector assembly comprises a coupling device with a spring element. The spring element is arranged axially between the fuel injector and the fuel injector cup, and the spring element is coupled to the fuel injector in a manner that a rotational movement of the spring element relative to the fuel injector with respect to the direction of the central longitudinal axis is blocked or prevented, wherein the at least one leg portion—in particular the at least one branch section thereof—is in engagement with a contact surface of the spring element in a manner that a rotational movement of the fuel injector relative to the fuel injector cup with respect to the direction of the central longitudinal axis is prevented by means of mechanical interaction via the spring element. Particularly, the at least one leg portion is in form-fit engagement with the contact surface of the spring element to block rotational movement of the fuel injector cup with respect to the spring element. This has the advantage that the spring element may be used to carry out the defined positioning of the fuel injector relative to the fuel injector cup in circumferential direction in a simple manner.

In a further embodiment a clip element is in engagement with the fuel injector cup and with the fuel injector in a manner that the fuel injector is retained in the fuel injector cup in direction of the central longitudinal axis. This has the advantage that a movement of the fuel injector relative to the fuel injector cup in direction of the central longitudinal axis may be prevented. Furthermore, the orientation of the fuel injector relative to the fuel injector cup in circumferential direction may be secured in a simple manner.

A fuel feed device 10 is assigned to an internal combustion engine 22 (FIG. 1) which can be a diesel engine or a gasoline engine. It includes a fuel tank 12 that is connected via a fuel line to a fuel pump 14. The output of the fuel pump 14 is connected to a fuel inlet 16 of a fuel rail 18. In the fuel rail 18, the fuel is stored under high pressure, for example, under the pressure of up to 300 bar, e.g. of about 200 bar, in the case of a gasoline engine or of more than 2,000 bar in the case of a diesel engine. Fuel injectors 20 are connected to the fuel rail 18 and the fuel is fed to the fuel injectors 20 via the fuel rail 18.

Figure 2:
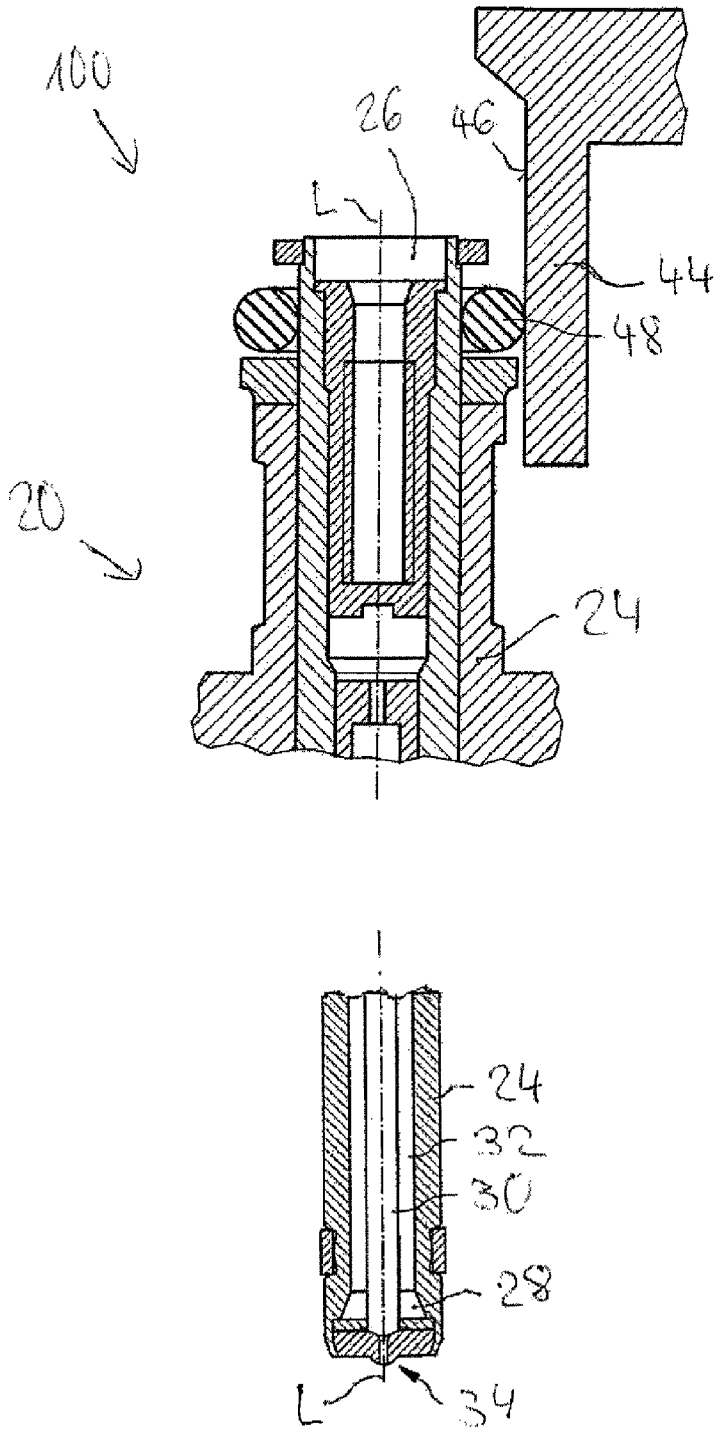
FIG. 2 is a schematic cross-sectional view of a portion of a fuel injector assembly according to a first example embodiment.

FIG. 2 shows a fuel injector assembly 100 according to a first exemplary embodiment with the fuel injector 20. The fuel injector 20 has a central longitudinal axis L. The fuel injector 20 has a fuel injector body 24 and is suitable for injecting fuel into a combustion chamber of the internal combustion engine 22. The fuel injector 20 has a fuel inlet portion 26 and a fuel outlet portion 28.

Furthermore, the fuel injector 20 comprises a valve needle 30 taken in a cavity 32 of the fuel injector body 24. The cavity 32 is axially led through the fuel injector body 24. On a free end of the fuel injector 20 an injection nozzle 34 is formed which is closed or opened by an axial movement of the valve needle 30. In a closing position a fuel flow through the fuel outlet portion 28 and the injection nozzle 34 is prevented. In an opening position fuel can flow through the fuel outlet portion 28 and the injection nozzle 34 into the combustion chamber of the internal combustion engine 22.

Figure 8:
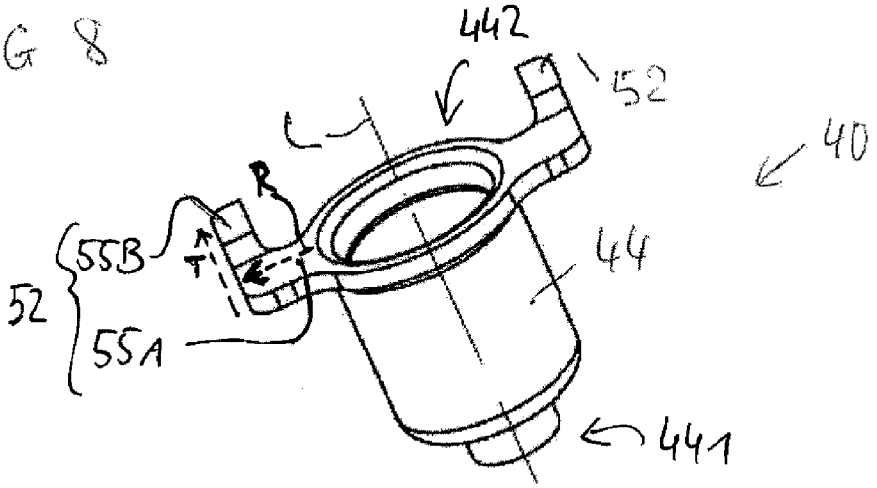
FIG. 8 is a perspective view of the coupling device of the fuel injector assembly according to the first example embodiment.

FIGS. 3 to 6 show different views of the fuel injector assembly 100 which comprises the fuel injector 20 and a coupling device 40. In FIG. 8, the coupling device 40 is shown separately. The coupling device 40 is coupled to the fuel rail 18 of the internal combustion engine 22.

The coupling device 40 comprises a fuel injector cup 44. The fuel injector cup 44 is mechanically and hydraulically coupled to the fuel rail 18 at an inlet side 441. The fuel injector cup 44 comprises an inner surface 46, the inner surface 46 in particular defining a recess of the fuel injector cup 44. The fuel injector cup 44 is in engagement with the fuel inlet portion 26 of the fuel injector 20 at an outlet side 442 of the fuel injector cup 44. In particular, the fuel injector 20 is inserted into the recess of the fuel injector cup 44 from the outlet side 442. The fuel inlet portion 26 of the fuel injector 20 comprises a sealing ring 48. In an assembled state the inner surface 46 of the fuel injector cup 44 is in sealing contact with the sealing ring 48 (FIG. 2). The central longitudinal axis L of the fuel injector 20 is identical with a longitudinal axis L of the fuel injector cup 44. In other words, the fuel injector 20 and the fuel injector cup 44 share the same longitudinal axis L.

The coupling device 40 comprises a collar element 50. The collar element 50 is fixedly coupled to the fuel injector cup 44. The collar element 50 is extending radially away from the fuel injector cup 44. In The collar element 50 is in one piece with the fuel injector cup 44. In further embodiments of the coupling device 40 the collar element 50 may be designed as a separate part from the fuel injector cup 44.

The collar element 50 comprises two leg portions 52. In further embodiments the collar element 50 may comprise one leg portion 52, 54 or more than two leg portions 52, 54.

Each of the leg portions has a bridge section 55A and one branch section 55B. The bridge sections 55A and the branch sections 55B are indicated with dashed lines in FIG. 6.

The bridge section 55A extends radially away from the fuel injector cup 44 in each case. The branch section 55B follows the bridge section 55A in a radial direction R away from the fuel injector cup 44. In a tangential direction T, the branch section 55B in each case projects beyond the bridge portion 55A. The tangential direction T is a direction which is perpendicular to the radial direction R and to the longitudinal axis (see, for example, FIG. 6). In addition, the branch section 55B projects beyond the bridge portion 55A and beyond the injector cup 44 in a direction along the longitudinal axis L which is directed from the inlet side 441 to the outlet side 442; in other words in direction of the fuel flow.

The leg portions 52 are L-shaped in top view along the longitudinal axis L. One side of the L-shape is parallel to the radial direction R and represented by the respective bridge portion 55A. One side of the L-shape is parallel to the tangential direction T and represented by the respective branch portion 55B.

The leg portions 52 are arranged axially symmetric relative to the central longitudinal axis L. The two branch sections 55B are arranged to constitute a bracket. This enables a very good coupling between the coupling device 40 and the fuel injector 20.

The fuel injector assembly 100 has a spring element 56. The spring element 56 is arranged axially between the fuel injector 20 and the fuel injector cup 44. The spring element 56 may limit a movement of the fuel injector 20 relative to the fuel injector cup 44 in direction of the central longitudinal axis L, specifically by means of mechanical interaction between the fuel injector 20 and the fuel injector cup 44 via the spring element 56. The fuel injector body 24 of the fuel injector 20 has a projection 58. The spring element 56 is in form-fit engagement with the projection 58 so that a rotational movement of the spring element 56 relative to the fuel injector 20 with respect to the central longitudinal axis L is prevented.

The leg portions 52 of the collar element 50 are in form-fit engagement with contact surfaces 60 of the spring element 56, so that the bracket formed by the branch sections 55B embraces the spring element 56 (FIGS. 3 to 6). By this a rotational movement of the spring element 56 relative to the fuel injector cup 44 may be prevented. As the spring element 56 is coupled to the fuel injector 20 in a manner that the rotational movement between the spring element 56 and the fuel injector 20 is prevented, a rotational movement of the fuel injector 20 relative to the fuel injector cup 44 with respect to the central longitudinal axis L is prevented as well.

By this a rotation of the fuel injector 20 around the longitudinal axis L may be avoided. This enables an indexing of the fuel injector 20.

Figure 3:
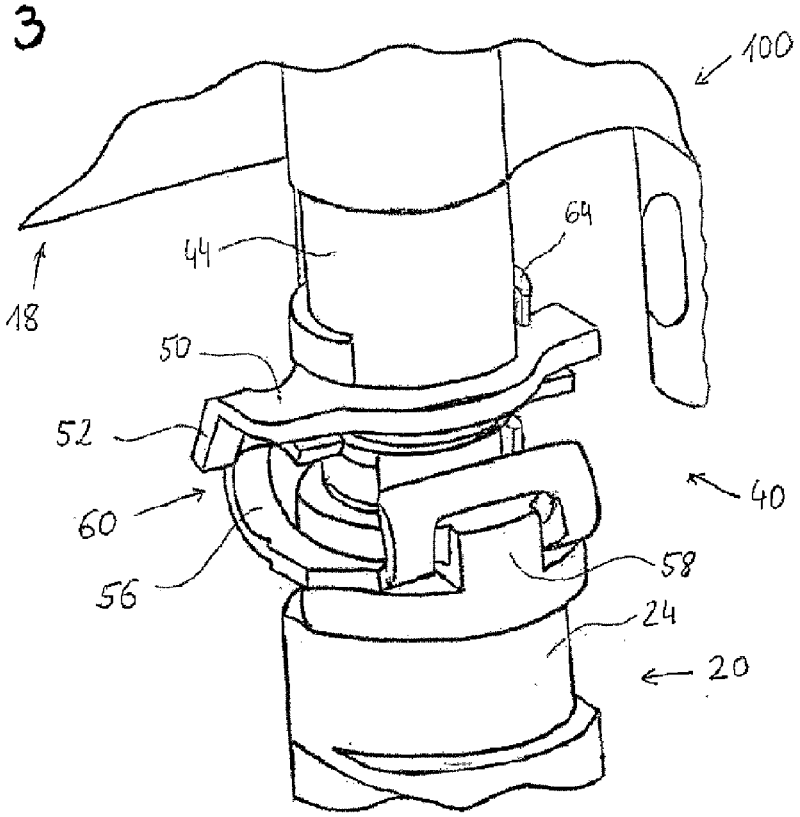
FIG. 3 is a perspective view of a portion of the fuel injector assembly according to the first example embodiment.
Figure 4:
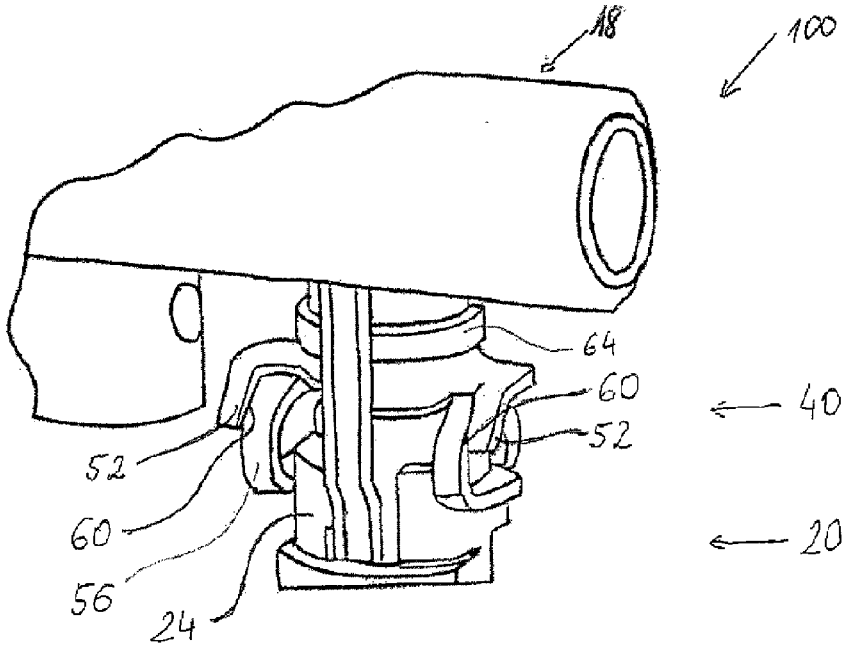
FIG. 4 is a further perspective view of a portion of the fuel injector assembly according to the first example embodiment.
Figure 5:
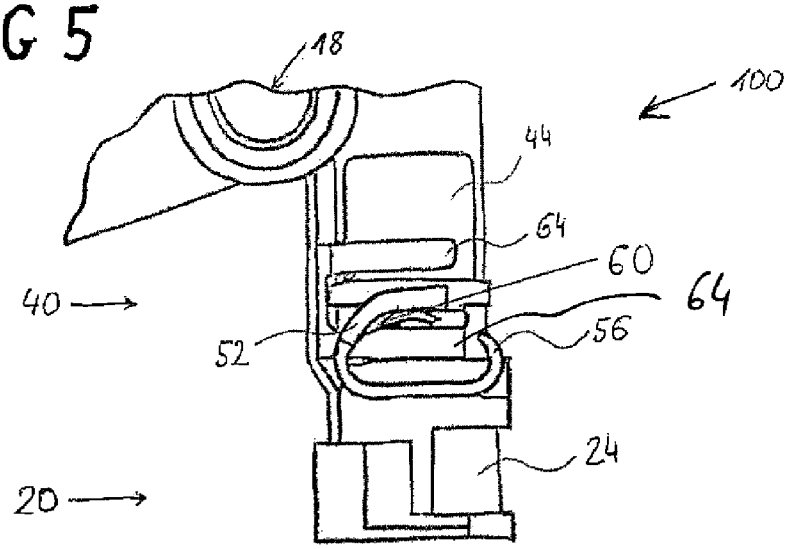
FIG. 5 is a side view of a portion of the fuel injector assembly according to the first example embodiment.
Figure 6:
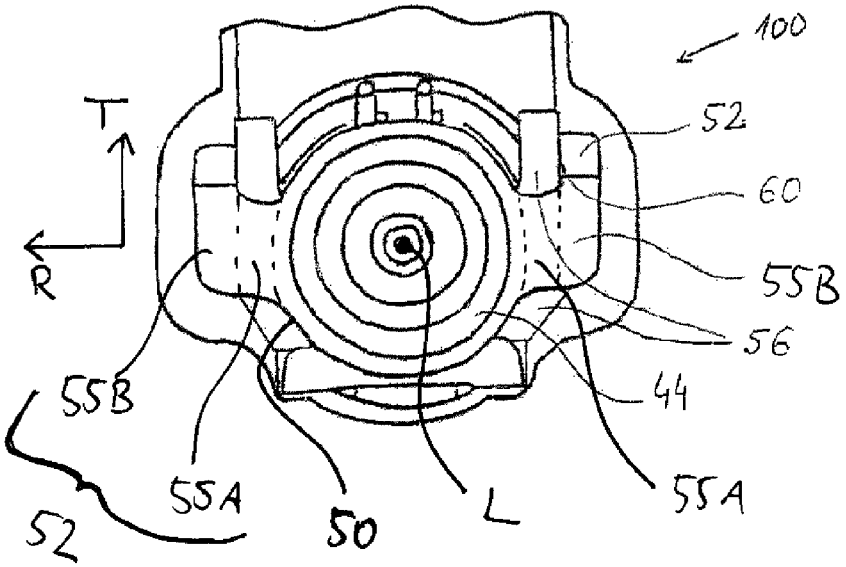
FIG. 6 is a top view of a portion of the fuel injector assembly according to the first example embodiment.

In the present embodiment of the fuel injector assembly 100, the fuel injector assembly 100 comprises a clip element 64, as shown in FIGS. 3 to 5. The clip element 64 comprises two C-shaped sections and a bar coupling the two C-shaped sections. The C-shaped sections are in engagement with the fuel injector cup 44 and the fuel injector 20 respectively. By this the fuel injector 20 is retained in the fuel injector cup 44 in direction of the central longitudinal axis L. This has the particular advantage that the fuel injector 20 may be kept engaged in the fuel injector cup 44 during a transport of the fuel injector assembly 100. Consequently, the orientation of the fuel injector 20 relative to the fuel injector cup 44 may be kept even during a transport of the fuel injector assembly 100.

Figure 7:
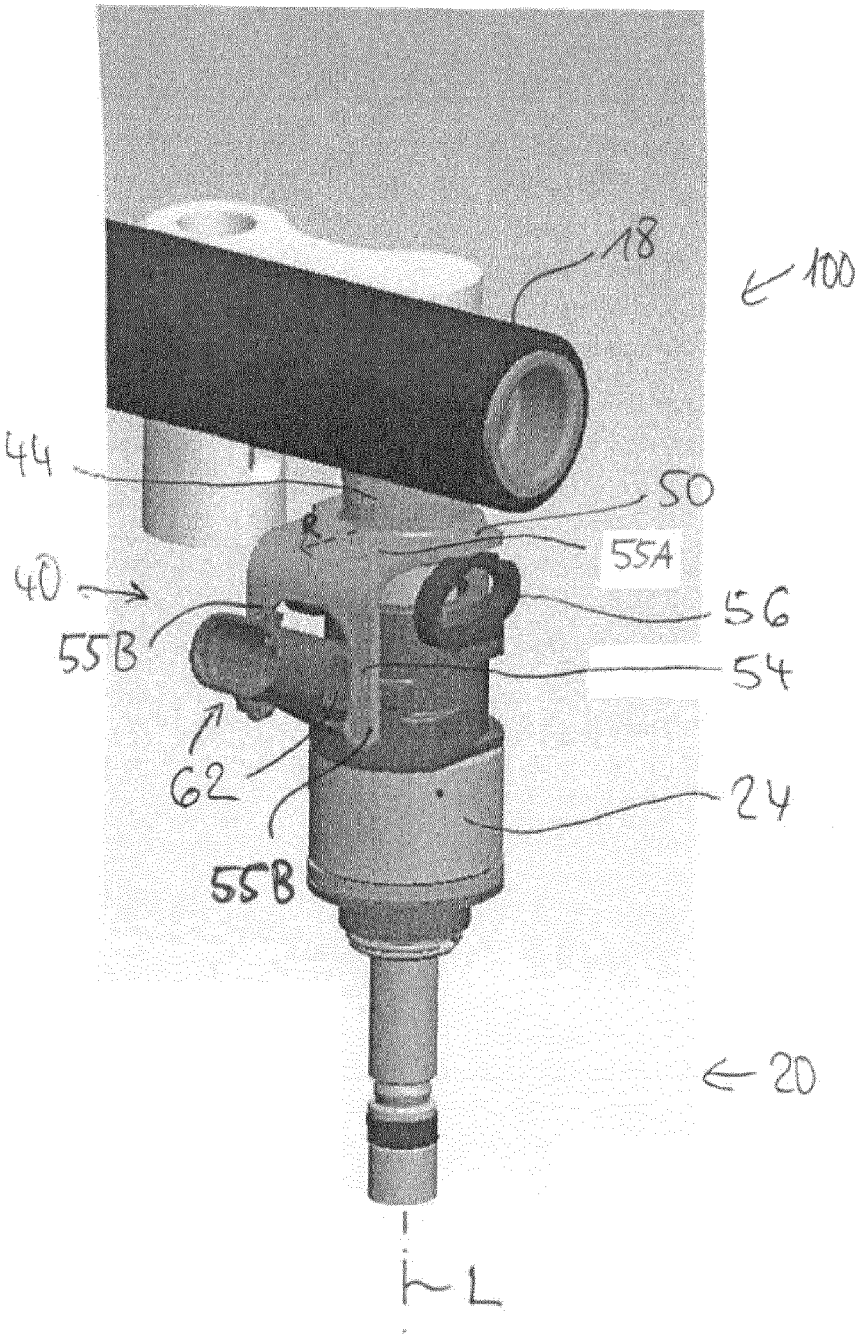
FIG. 7 is a perspective view of a fuel injector assembly according to a second example embodiment.

FIG. 7 shows a perspective view of a fuel rail assembly 100 according to a second exemplary embodiment.

In contrast to the first embodiment, the collar element 50 only comprises one leg portion 54 in the present embodiment. The leg portion 54 it T-shaped in top view along the longitudinal axis L. The T-shape is constituted by the bridge section 55A which extends in a radially outward direction R and by two branch sections 55B which follow the bridge section 55A in this direction and which—slightly—project beyond the bridge section 55A in tangential direction T, i.e. in a direction perpendicular to the radially outward direction R and to the longitudinal axis L, on opposite sides of the bridge portion 55A. The bridge section 55A represents the "vertical" line of the T-shape, the "cross-beam" of the "T" is formed by means of the branch sections 55B. In an alternative embodiment, the branch sections 55B do not project beyond the bridge section 55A in the tangential direction T. The branch sections 55B have a main extension direction along the longitudinal axis L and are spaced apart from each other in a side view of the longitudinal axis along the radial direction R to form a bracket. The leg portion 54 is in form-fit engagement with contact surfaces 62 of the fuel injector 20 by means of the bracket embracing a part of an injector housing, for example an electrical connection port. By this a direct contact between the leg portion 54 and the fuel injector body 24 is enabled, and a rotational movement of the fuel injector 20 relative to the fuel injector cup 44 around the central longitudinal axis L may be avoided. The collar element 50 with the T-shaped leg portions 54 may prevent a rotation of the fuel injector 20 relative to the fuel injector cup 44 in a very secure manner.

The collar element 50 of the present embodiment further comprises tabs extending in opposite radial directions. The tabs are provided for supporting a spring element 56 of the fuel injector assembly 100. The spring element 56 is, for example, provided for forcing the fuel injector 20 in contact with a cylinder head of the internal combustion engine 22.

Figure 9:
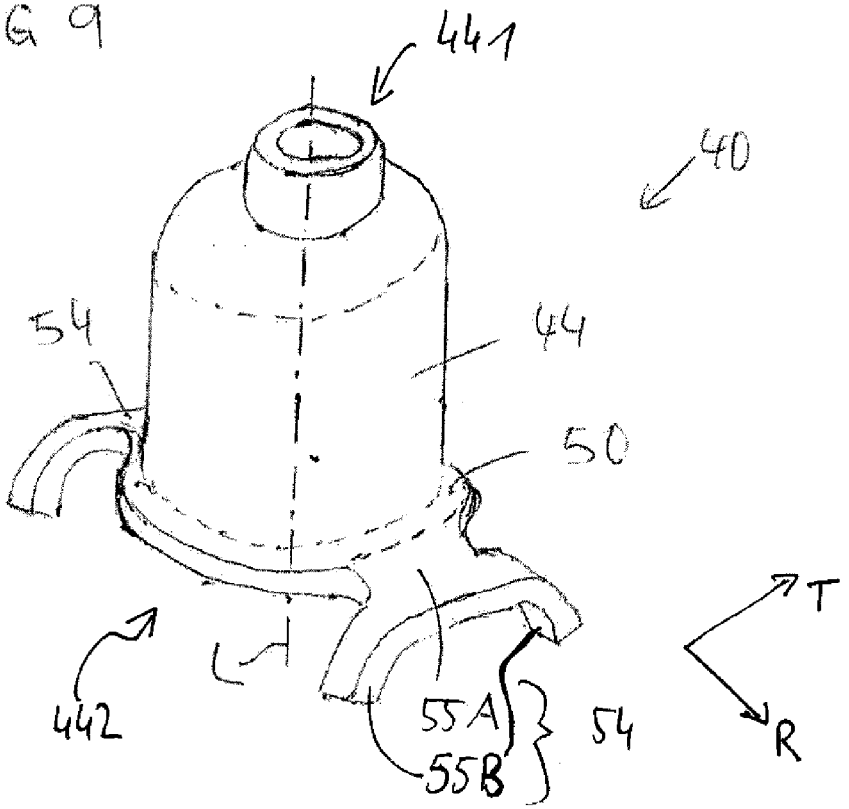
FIG. 9 is a perspective view of a coupling device according to a third example embodiment.

FIG. 9 shows a coupling device 40 according to the third exemplary embodiment which may be useful, for example, for the fuel injector assembly 100 according to a variant of the first embodiment. The coupling device 40 may generally have the same construction as the coupling device 40 according to the first exemplary embodiment.

The coupling device 40 according to the present embodiment has two legs 54, protruding radially outward in axially symmetric fashion relative to the central longitudinal axis L. Each leg 54 has a bridge section 55A, the bridge sections 55A extending away from the fuel injector cup 44 in a radial direction R. The coupling device may have mirror symmetry in a plane comprising the longitudinal axis L and being perpendicular to the radial direction R.

Each leg 54 has two branch sections 55B which laterally project beyond the respective bridge section 55A on opposite sides of the bridge section 55A, i.e. they project beyond the bridge section 55A in a tangential direction T being perpendicular to the radial direction R and to the longitudinal axis L. In this way, a T-shape of the respective leg 54 is constituted by the bridge section 55A and the branch sections 55B in top view along the longitudinal axis L.

In the course away from the bridge section 55A along the tangential direction T, the branch sections 55B are curved in a direction away from the inlet side 441 so that they project beyond the bridge section 55A and the fuel injector cup 44 in a direction along the longitudinal axis L which is directed from the inlet side 441 to the outlet side 442. In a side view along the radial direction R, the branch sections 55B together have a U-shape which opens towards the outlet side 442. In this way, a particularly secure rotational locking of the fuel injector cup 44 is achievable.

The proposed fuel injector assembly 100 has the advantage that the collar element 50 may operate as an indexing feature of the fuel injector cup 44. Furthermore, the collar element 50 may be manufactured together with the fuel injector cup 44 in a deep drawn process without any additional component. This enables a very simple process handling and an economical benefit. Furthermore, a packaging benefit may be obtained by carrying out the indexing on side faces of the fuel injector 20.

The invention is not limited to specific embodiments by the description on the basis of said exemplary embodiments but comprises any combination of elements of different embodiments. Moreover, the invention comprises any combination of claims and any combination of features disclosed by the claims.

What is claimed is:

1. A coupling device joining a fuel injector to a fuel rail of a combustion engine, the coupling device comprising:

a fuel injector cup having a central longitudinal axis and an inlet side at a first end of the fuel injector cup hydraulically coupling to the fuel rail and an outlet side at a second end configured for engaging a fuel inlet portion of the fuel injector, a collar fixedly coupled to the fuel injector cup at the second end, and a spring element engaging a protrusion of the fuel inlet portion of the fuel injector to fix a relative position between the spring element and a fuel injector body, wherein the collar comprises two leg portions, each of the two leg portions having a bridge section and at least one branch section, wherein the bridge section extends radially away from the fuel injector cup, wherein the at least one branch section is arranged outward from the bridge section in a radial direction away from the fuel injector cup, wherein the at least one branch section (a) projects beyond the bridge section along a tangent perpendicular to the radial direction and perpendicular to the central longitudinal axis and (b) projects in a direction parallel to the central longitudinal axis in a direction from the inlet side toward the outlet side, and wherein the spring element is compressed between the collar and the fuel injector body, blocking a rotational movement of the fuel injector relative to the fuel injector cup and biasing the fuel injector body away from the fuel injector cup along the central longitudinal axis.

2. The coupling device of claim 1, wherein the at least one branch section extends longitudinally beyond the fuel injector cup in the direction along the central longitudinal axis.

3. The coupling device of claim 1, wherein the collar and the fuel injector cup are formed as a unitary piece.

4. The coupling device of claim 1, wherein each of the two leg portions has one branch section is L-shaped in a top view along the central longitudinal axis, wherein each of the bridge section and the one branch section define a respective portion of the L-shape.

5. The coupling device of claim 1, wherein each of the two leg portions has two branch sections projecting beyond the bridge section on opposite sides along the tangent, such that each of the two leg portions is T-shaped in a top view along the central longitudinal axis.

6. The coupling device of claim 5, wherein the two branch sections define a bracket for enclosing a portion of either (a) the fuel injector or (b) the spring element of the coupling device.

7. The coupling device of claim 1, wherein the at least one branch section of each of the two leg portions projects beyond the respective bridge section in the tangential direction perpendicular to a respective radial direction and perpendicular to the central longitudinal axis and in a direction parallel to the central longitudinal axis in a direction from the inlet side to the outlet side, the two leg portions being arranged axially symmetric with respect to the central longitudinal axis.

8. A fuel injector assembly, comprising:

a fuel injector having a fuel injector body, and a coupling device comprising:

a fuel injector cup having a central longitudinal axis and extending from an inlet side configured for hydraulically coupling to a fuel rail and an outlet side configured for engaging a fuel inlet portion of the fuel injector, a collar fixedly coupled to the fuel injector cup, and a spring element engaging a protrusion of the fuel inlet portion of the fuel injector to fix a relative position between the spring element and the fuel injector body, wherein the collar comprises two leg portions each having a bridge section and at least one branch section, wherein the bridge section extends radially away from the fuel injector cup, wherein the at least one branch section is arranged outward from the bridge section in a radial direction away from the fuel injector cup, wherein the at least one branch section (a) projects beyond the bridge section along a tangent which is perpendicular to the radial direction and perpendicular to the central longitudinal axis and (b) projects in a direction parallel to the central longitudinal axis in a direction from the inlet side toward the outlet side, and wherein the spring element is engaged with the protrusion and coupled to the collar, the spring element is compressed between the collar and the fuel injector body, blocking a rotational movement of the fuel injector relative to the fuel injector cup and biasing the fuel injector away from the fuel injector cup along the central longitudinal axis.

9. The fuel injector assembly of claim 8, wherein the at least one branch section of the collar engages with a contact surface of the fuel injector such that a rotational movement of the fuel injector relative to the fuel injector cup in a direction of the central longitudinal axis is blocked.

10. The fuel injector assembly of claim 8, comprising a clip element engaged with the fuel injector cup and with the fuel injector such that the fuel injector is retained in the fuel injector cup in a direction of the central longitudinal axis.

11. The fuel injector assembly of claim 8, wherein the at least one branch section of the collar of the coupling device extends longitudinally beyond the fuel injector cup in the direction along the central longitudinal axis.

12. The fuel injector assembly of claim 8, wherein the collar and the fuel injector cup are formed as a unitary piece.

13. The fuel injector assembly of claim 8, wherein each of the two leg portions of the collar of the coupling device has one branch section and is L-shaped in a top view along the central longitudinal axis, wherein each of the bridge section and the one branch section define a respective portion of the L-shape.

14. The fuel injector assembly of claim 8, wherein each of the two leg portions of the collar of the coupling device has two branch sections projecting beyond the bridge section in opposite directions along the tangent, such that each of the two leg portions is T-shaped in a top view along the central longitudinal axis.

15. The fuel injector assembly of claim 8, wherein the at least one branch section of each of the two leg portions projects beyond the respective bridge section in the tangential direction perpendicular to a respective radial direction and perpendicular to the central longitudinal axis and in a direction parallel to the central longitudinal axis in a direction from the inlet side to the outlet side, the two leg portions being arranged axially symmetric with respect to the central longitudinal axis.

16. The fuel injector assembly of claim 15, wherein the two leg portions each comprise two branch sections and the two branch sections of each leg portion of the coupling device define a bracket for enclosing a portion of either (a) the fuel injector or (b) the spring element of the coupling device.

* * * * *